United States Patent [19]

Lindroth et al.

[11] Patent Number: 5,003,144

[45] Date of Patent: Mar. 26, 1991

[54] MICROWAVE ASSISTED HARD ROCK CUTTING

[75] Inventors: David P. Lindroth, Apple Valley; Roger J. Morrell, Bloomington; James R. Blair, Inver Grove Heights, all of Minn.

[73] Assignee: The United States of America as represented by the Secretary of the Interior, Washington, D.C.

[21] Appl. No.: 506,054

[22] Filed: Apr. 9, 1990

[51] Int. Cl.[5] ..... H05B 6/80

[52] U.S. Cl. ..... 219/10.55 A; 219/10.55 R; 299/14

[58] Field of Search ..... 219/10.55 A, 10.55 R, 219/10.55 M, 10.55 F; 299/14

[56] References Cited

U.S. PATENT DOCUMENTS

| | | | |
|---|---|---|---|
| 3,219,280 | 11/1965 | Seldenrath et al. | 299/14 X |
| 3,430,021 | 2/1969 | Watson | 219/10.55 A |
| 3,443,051 | 5/1969 | Puschner | 219/10.55 R |
| 3,601,448 | 8/1971 | Stone | 299/14 |
| 3,614,163 | 10/1971 | Anderson | 299/14 |
| 3,826,536 | 7/1974 | Boyd et al. | 299/14 |
| 4,319,856 | 3/1982 | Jeppson | 299/14 X |

*Primary Examiner*—Philip H. Leung
*Attorney, Agent, or Firm*—E. Philip Koltos

[57] ABSTRACT

An apparatus for the sequential fracturing and cutting of subsurface volume of hard rock (102) in the strata (101) of a mining environment (100) by subjecting the volume of rock to a beam (25) of microwave energy to fracture the subsurface volume of rock by differential expansion; and , then bringing the cutting edge (52) of a piece of conventional mining machinery (50) into contact with the fractured rock (102).

1 Claim, 1 Drawing Sheet

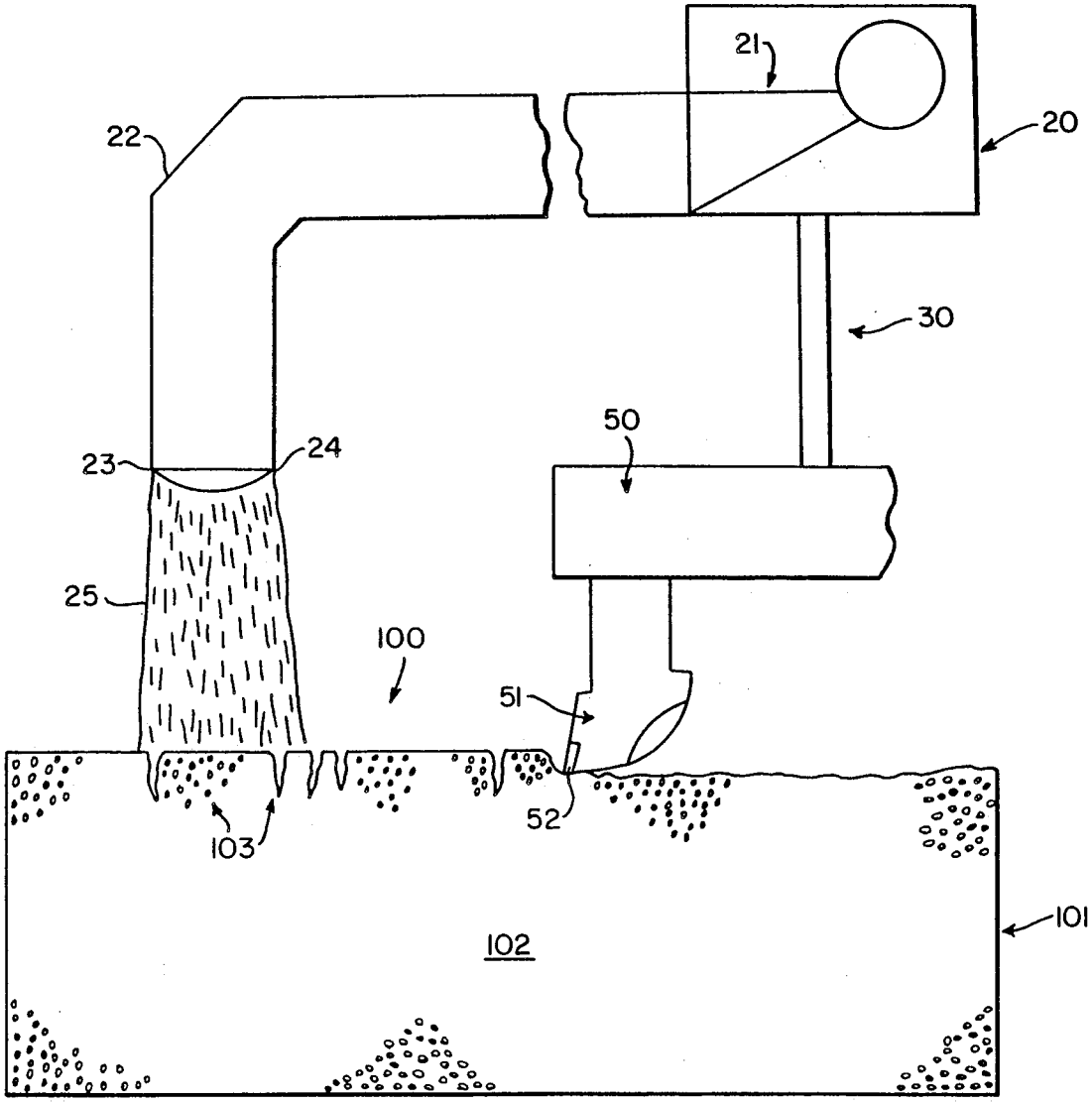
20
21
22
23
24
25
30
50
51
52
100
101
102
103

MICROWAVE ASSISTED HARD ROCK CUTTING

TECHNICAL FIELD

This present invention relates to the use of microwave radiation to facilitate the mining of hard rocks by the sequential and simultaneous exposure of a rock strata to microwave radiation followed by a mechanical cutting tool.

BACKGROUND ART

While the application of microwave radiation to fracture relatively soft manmade surfaces such as concrete is recognized by the prior art, to date no one has applied that technology to fracture naturally occurring hard rock formations in a mining environment.

During the past twenty years on cutting and fragmentation of hard rock, it was realized that the metallurgical strength limits had been reached with conventional mechanical systems. An alternative way to make improvements in cutting and fragmenting of hard rock is to preweaken/fracture it ahead of the mechanical cutting tool by applying another form of energy. Past and current research has shown microwave energy to be a viable candidate for a combination energy/cutting fragmentation system. The selection of a suitable method for fragmentation is based, among other factors, on economic and practical operating requirements. Modifying and improving existing methods and developing new methods of fragmentation becomes necessary for cost reduction and increasing the speed and efficiency of operation.

A wide variety of mechanical fragmentation machinery, such as boring, tunneling, and continuous mining machines, are available for cutting rock formations having strengths ranging from soft up to the lower range of medium hard (12->25 Kpsi compressive strength). However, for formations in the upper ranges of medium-hard to hard rock (>25 Kpsi) this type of machinery will not be able to cope competitively.

The physics and mechanics of rock fragmentation employing mechanical tools is well understood. The problem is two-fold: first, the inability of many excavators to provide the high thrust and torque necessary to achieve acceptable production rates, and/or second, the inability of the mechanical cutters to survive the high forces encountered in hard rock cutting. Current indications are that the tungsten carbide, used as the bit cutting surface, has been taken to its limit and further improvements are not expected. Therefore, the drag bits used as the mechanical tools have likewise reached their limits.

Previous research on thermally-assisted cutting of hard rock employing surface heating techniques showed the heat-weakening concept technically feasible, but economically and practically unattractive for gas jets, lasers and radiant electric heaters. Subsurface fracturing and weakening of the rock was achieved, but is limited to a slow rate due to the thermal properties of the material.

Previous patents on microwave fracturing of concrete and other brittle materials have used the microwave energy alone to fragment the material. All operate on the principal of differential thermal expansion causing tensile stress fracturing to occur within the material. The combined process of microwave-mechanical cutting is not mentioned.

Rock fragmentation is a basic requirement of the minerals industry. The term "fragmentation" is often associated with irreversible structural changes in the failure of crystalline solids and is defined here as the process of breaking a rock into two or more parts by separation and formation of new surfaces. This physical irreversibility results from energy dissipation within the rock. Rock is herein defined as a polycrystalline aggregate or amorphous solid composed of one or more minerals in aggregate and includes the categories, basalt, granite, gabbro, multiphase ore, and quartzites. Hard rock is herein defined as the rock above having a confined compressive strength greater than 25,000 psi.

DISCLOSURE OF THE INVENTION

The present invention is a combined electromagnetic and mechanical energy forms to provide cutting rocks and which uses microwave radiation to thermally preweaken the rock before it is attacked by the mechanical cutter machinery itself. With this apparatus the rock is first thermally preweakened by applying the microwave energy immediately ahead of the cutter and secondly, is physically cut by encountering the mechanical cutting bit/tool. The mechanical cutting device/bit/tool is typical of the state of the art with the exception of the introduction of the microwave radiation equipment.

The noncontact radiation transfer of energy by microwaves does not interrupt the mechanical cutting, but does manifest a change in the rock; weakening it by any number of a variety of phenomena.

When the rock is internally heated by microwave radiation, the heat generated is independent of the heat transfer properties of the rock material, and instead is dependent upon other rock property parameters which govern the process of heat generation. Internal heating utilizes the inherent properties of rock material for heat generation and can be induced by electrical methods in the form of electromagnetic waves in the microwave region. In this invention, the term microwave refers to electromagnetic radiation in the frequency range from 900 MHz to 300 GHz. The energy transfer process is by radiation and is a noncontact process. The energy transfer process works in the following manner.

Given a plane monochromatic electromagnetic wave of unit amplitude, normally incident on a material, a reflected wave of amplitude ($\rho$) results where $\rho$ is equal to the reflection coefficient of the interface and the remainder of the incident wave is refracted into the material. Part of the energy associated with the refracted wave is absorbed and released as heat in the material and thus, the amplitude of the absorbed wave decays exponentially with the depth in the material (X) according to the relation $\exp(-\alpha X)$ where $\alpha$ is the attenuation constant. The reflection coefficient and attentuation constant depend upon the permittivity $\epsilon$ and permeability $\mu$ of the material. The permeability $\mu$ will be assumed equal to that of free space for this discussion. The microwave properties of the material are thus described by the permittivity $\epsilon$, where $\epsilon=\epsilon'-j\epsilon''$. If these quantities are normalized with respect to the permittivity of free space ($\epsilon_o$), $\epsilon'$ is referred to as the relative permittivity, $\epsilon''$ as the relative loss factor of the material, the loss tangent is defined as $\tan\delta=\epsilon''/\epsilon'$, and $j=\sqrt{-1}$. The attenuation produced by rock is frequently expressed in terms of the penetration depth $1/\alpha$ through which the field decays to $1/e=0.368$ of its original value. When the relative loss factor is small, these quantities are related by the reflection coefficient, $$\rho=(1-\sqrt{\epsilon})/(1+\sqrt{\epsilon})$$

and $$1/\alpha = \frac{\lambda}{2\pi}\left[\frac{2}{\epsilon'(\sqrt{1+\tan^2\delta}-1)}\right]^{\frac{1}{2}}$$

where $\lambda$ is the free space wavelength.

The penetration depth is thus indirectly proportional to the product of loss tangent and the dielectric constant, and directly proportional to the wavelength $\lambda$. The above equation aplies to the idealized situation and contains useful information. If the dielectric properties of the material are known or can be measured, the preceding equation can be used to calculate the attenuation constant and penetration depth. If penetration depth is less than the dimensions of the object to be heated, the microwave energy will not provide completely uniform heating of the object since a large portion of the refracted energy will be absorbed before reaching the center of the object. Conversely, if the penetration depth is much greater than the dimensions of the object to be heated, microwave energy will permeate the object, but little will be absorbed. In either situation, special design techniques may be required to realize the desired effect. The parameter available to control penetration depth is the wavelength $\lambda$.

For this application, rocks may be composed of either nonmagnetic metals or nonmetals. A metal can be considered a dielectric with the relative loss factor $\epsilon''=60\lambda\sigma$ where $\sigma$ is the conductivity of the metal. For most metals $\sigma$ and hence $\epsilon''$ are very large. In this case, the reflection coefficient $\rho$ is very close to unity and only a very small portion of the incident power is transmitted into the metal. This transmitted energy is rapidly attenuated and does not penetrate the metal to any substantial extent. For metals such as silver, copper, gold, aluminum, magnesium, brass, and platinum, the penetration depth varies from $10^{-4}$ to $5\times10^{-3}$ cm at 2,450 MHz. Thus the energy is reflected from the metallic components in the rock and directed into the nonmetallic part. This phenomenon helps break the waste mineral away from the wanted mineral. The microwaves easily heat the nonmetallic part of the rock internally to a depth $1/\alpha$. The resultant heating causes differential volumetric thermal expansion which creates an internal thermal stress concentration buildup and the resultant production of microfractures.

Only enough energy is put into the rock to thermally preweaken a subsurface volume by microfracturing. This reduction in rock strenght in turn reduces the amount of mechanical energy required by the cutting tool to achieve the desired fragmentation. For porous rock that has a small loss factor but contains free water, the microwave energy will be deposited in the water. This will generate internal steam pressure that will assist prefracturing of the rock.

The amount of power, P, dissipated in a unit volume of rock submersed in an electric field E, is given by $$P=2\pi f\epsilon_0\epsilon'\tan\delta E^2,$$

where f=frequency, $\epsilon_0$ is the permittivity of free space, and $\epsilon'\tan\delta$ is the loss factor.

The loss factor for a given rock varies with the frequency and temperature which allows optimization of the cutting system. For a given rock exposed to a given electromagnetic field, E will have a theoretically calculable distribution throughout the object and, thus, the power absorption and heating distribution can be determined. In practice, the distribution of E is calculable only for simple shapes, such as spheres, ellipsoids, etc., or when some object dimension are either large or small compared to $\lambda$. The theoretical heating rate of the material is given by $$\frac{dT}{dt}=\frac{P}{\Delta\cdot Cp},$$

where $\Delta$=density,

Cp=specific heat,

T=temperature.

t=time.

By using the aforementioned method in a mining environment, substantial savings and benefits are realized such as: increased cutting or penetration rates, reduced mechanical wear, increased tool life which lowers tool replacement costs; and, increased overall cutting efficiency due to the reduction in energy expenditure required to mine a given volume of rock over conventional mining techniques.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings, wherein:

FIG. 1 is a schematic diagram of the apparatus of this invention.

BEST MODE FOR CARRYING OUT THE INVENTION

As can be seen by reference to FIG. 1, the apparatus of this invention is intended to be used in a mining environment designated generally as (100); wherein, the mining environment comprises strata (101) of medium to hard rock (102); and wherein the hard rock (102) for the purposes of this invention has a confined compressive strength greater than 25 Kpsi.

The apparatus includes a conventional piece of mining machinery (50) having a standard cutting member (51), such as a flat faced drag bit, point attack bit, disk bit, roller bit, or the like, which is normally used to cut, penetrate, bore, or otherwise fracture and fragment the hard rock (102) in the mine strata (101).

As mentioned previously, the heart of this invention involves the combination of a microwave energy generator unit (20) used in conjunction with standard cutting member (51) in a mining environment (100).

The microwave energy generator unit (20) as depicted schematically in FIG. 1, comprises a source of microwave energy (21) having a wave guide transmission line (22) equipped with beam shaping optics (23) of either the reflecting or refracting type at the exit aperture (24) of the transmission line (22); wherein the beam shaping optics (23) project the microwave beam (25) onto the top surface of the rock strata (101).

As can also be seen by reference to FIG. 1, in the preferred embodiment of this invention, the microwave energy generator unit (20) is provided with means (30) for mounting the generator unit (20) on a conventional piece of mining machinery (50), wherein the exit aperture (24) of the wave guide transmission line (22) is disposed in front of the cutting edge (52) of the cutting member (51).

Therefore, when the microwave beam (25) is incident on the rock strata (101), the beam (25) penetrates a volume of the hard rock (102) to a given depth to produce fractures (103) due to differential expansion. In this version of the preferred embodiment, the microwave beam energy is deposited a short distance ahead of the cutting edge (52) of the cutting member (51) such that the cutting takes place while the rock strata (101) is at an elevated temperature.

Having thereby described the subject matter of this invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A combined apparatus for the fracturing and cutting of hard rock having a compressive strength of at least 25 Kpsi in the rock strata in a mining environment, said combined apparatus comprising:

a mining machine including a cutting member with a cutting edge; and a microwave energy generator means, mounted on said mining machine, for projecting a beam of microwave energy onto the surface of the rock strata such that the beam penetrates and fractures a subsurface volume of the rock strata by differential expansion, said microwave energy generator means comprising a source of microwave energy, a wave guide transmission line connected to said source, and including an exit aperture, beam shaping optics at the exit aperture of the transmission line for projecting the microwave beam onto said surface of said rock strata; and means for mounting said microwave generator means on said mining machine such that said exit aperture of said wave guide transmission line is disposed in front of said cutting edge of said cutting member.

* * * * *